US009637909B1

(12) United States Patent
Penny

(10) Patent No.: US 9,637,909 B1
(45) Date of Patent: May 2, 2017

(54) DRAIN CLEANING DEVICE

(71) Applicant: Jack Daniel Penny, Lake Mary, FL (US)

(72) Inventor: Jack Daniel Penny, Lake Mary, FL (US)

(73) Assignee: Swift Building Services, LLC, Lake Mary, FL (US)

( * ) Notice: Subject to any disclaimer, the term of this patent is extended or adjusted under 35 U.S.C. 154(b) by 0 days.

(21) Appl. No.: 15/189,030

(22) Filed: Jun. 22, 2016

Related U.S. Application Data

(60) Provisional application No. 62/391,475, filed on May 2, 2016.

(51) Int. Cl.
*B08B 9/045* (2006.01)
*E03F 9/00* (2006.01)
*E03C 1/302* (2006.01)

(52) U.S. Cl.
CPC ..... *E03F 9/005* (2013.01); *B08B 9/045* (2013.01); *E03C 1/302* (2013.01)

(58) Field of Classification Search
CPC ..... B08B 9/045; E03C 1/302; E03F 9/002; E03F 9/005
See application file for complete search history.

(56) References Cited

U.S. PATENT DOCUMENTS 1,523,170 A 1/1925 Cornelius
1,783,256 A 12/1930 Miller
1,817,015 A 8/1931 Miller
1,858,509 A * 5/1932 Kjerulff ..... E03F 9/002 15/104.33
1,978,957 A * 10/1934 Pardieck ..... E03C 1/302 15/104.33
2,178,801 A 11/1939 Mattern et al.
2,180,437 A * 11/1939 Smith ..... E03C 1/302 15/104.33
2,470,225 A 5/1949 Silverman
3,195,548 A 7/1965 Lestakis
3,971,544 A 7/1976 Smith, Jr.
4,218,802 A 8/1980 Babb et al.
4,287,630 A 9/1981 Perez
4,687,011 A 8/1987 Masaru
4,692,957 A 9/1987 Kovacs
4,771,500 A * 9/1988 Kovacs ..... B08B 9/045 15/104.33
6,249,927 B1 6/2001 Ando
8,312,572 B2 11/2012 Heffner

* cited by examiner

*Primary Examiner* — Randall Chin
(74) *Attorney, Agent, or Firm* — John V. Stewart

(57) ABSTRACT

A drain snake (4) with a ball (8, 42) on a forward end of a cable (6), the ball having a convex leading surface (36) with a protrusion (10, 44) designed to act as a foot that steps over the end (22, 30) of a pipe (24) in an elbow (26) as the snake is rotated (32). In an embodiment, the protrusion may terminate laterally at 60-150% of a maximum lateral extent (R, 37) of the ball or the protrusion may be limited to the lateral extent of the ball. The protrusion may form a rotationally asymmetric surface arrangement on the ball. The protrusion may have a forward cutting edge (48, 53) and may have a lateral cutting edge (52). The cable (6) may be designed to flex laterally while remaining substantially inelastic axially under manual feed and retraction forces.

20 Claims, 6 Drawing Sheets

P1
36

C
W
8
40
34
E1
A1
6
R
A2
37
10
38

C
46
6
48
E3
44
42
47
34

P1

36
6
W
8
40
34
E4
A1
C
R
37
10
P2

FIG 15
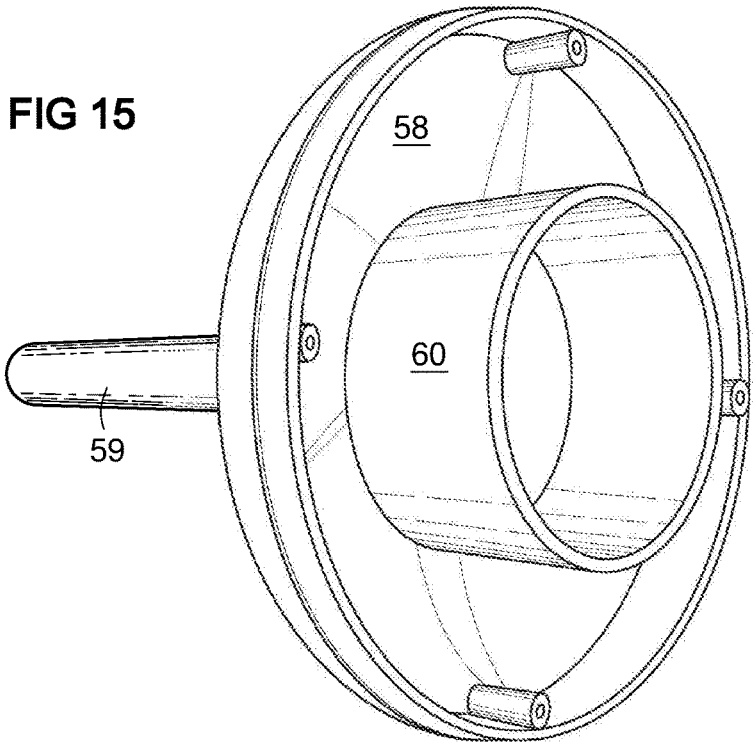
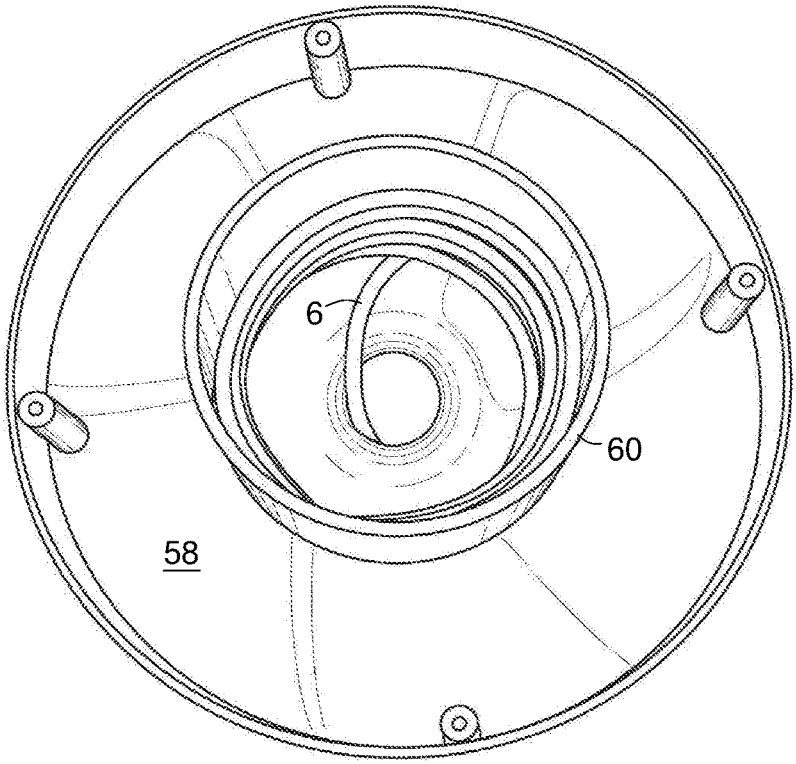
FIG 16

DRAIN CLEANING DEVICE

This application claims benefit of the May 2, 2016 filing date of U.S. provisional patent application 62/391,475 which is incorporated by reference herein.

FIELD OF THE INVENTION

This invention relates to drain cleaning snakes, and particularly to a ball and protrusion configuration on the leading end of the snake for passing a step in an elbow of a drain pipe, the step formed by the end of the connected continuing pipe section.

BACKGROUND OF THE INVENTION

A drain cleaning snake is a cable inserted into a drain pipe to clear deposits blocking the drain. Such devices are used for sink drains, toilet drains, and household sewer pipes. The cable is rotated during insertion to help the leading end of the snake pass through curves in the pipe such as grease traps and to work through blockages.

These devices are operable in drain pipes with only smooth curves such as grease traps. However, condensate drains for equipment such as air conditioners, refrigeration units, and dehumidifiers are often formed with smaller pipes having elbows that are sharply curved 90 degrees and are not smooth. One common type of condensate drain is formed of 19 mm (¾ inch) PVC pipe with multiple elbows to route the pipe from the equipment to a desired outflow location. A PVC elbow creates a step or ledge 30 as shown in FIGS. 5-8. The ledge is formed by the end of the continuing pipe section 24.

Conventional drain snakes will not pass such a ledge 30, so condensate drains are cleaned by using a vacuum attachment on a wet/dry shop vacuum and/or with chemicals and/or water pressure. None of these methods are as effective, convenient, inexpensive, and safe as a drain snake in accordance with the invention.

SUMMARY OF THE INVENTION

As shown in FIGS. 5-8, the invention provides an end ball 8 on a drain snake cable with a protrusion 10 designed specifically to step the ball 8 over a ledge 30 when the ball is rotated during insertion into the drain pipe 20, 24.

BRIEF DESCRIPTION OF THE DRAWINGS

The invention is explained in the following description in view of the drawings that show:

FIG. 15 is a perspective view of a conventional drain snake canister adapted with an inner canister to support an embodiment of the invention.

FIG. 16 is a perspective back view of the adapted canister of FIG. 16 with a cable coiled in the inner canister.

DETAILED DESCRIPTION OF THE INVENTION

Figure 1:
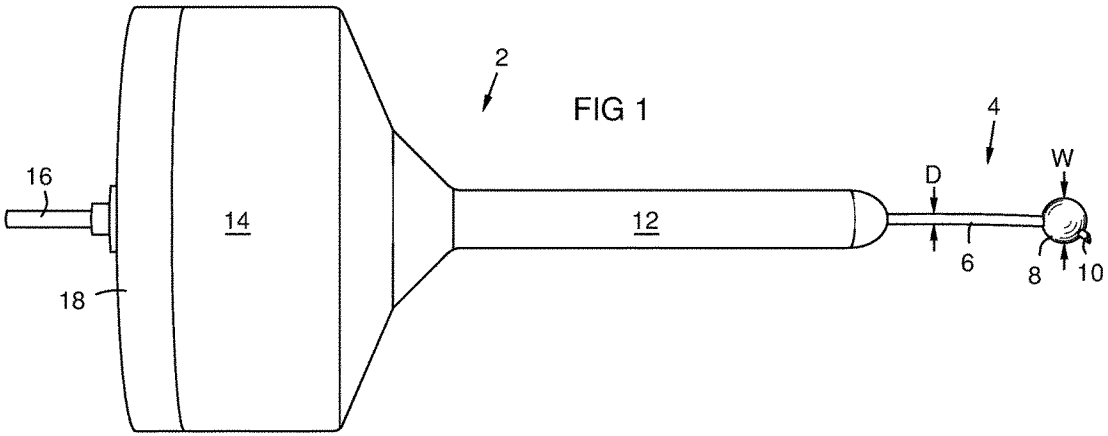
FIG. 1 is a side view of a drain cleaning device according to aspects of an embodiment of the invention.
Figure 2:
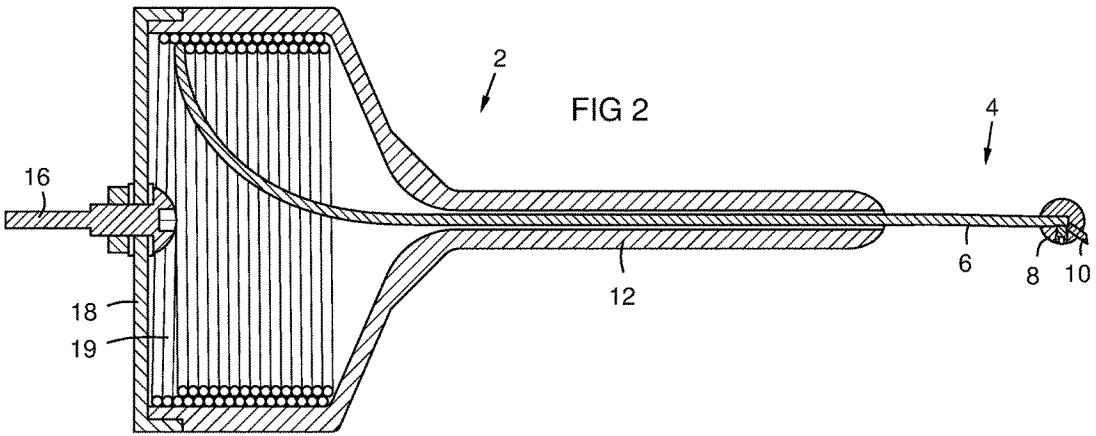
FIG. 2 is a sectional side view of the device of FIG. 1.
Figure 3:
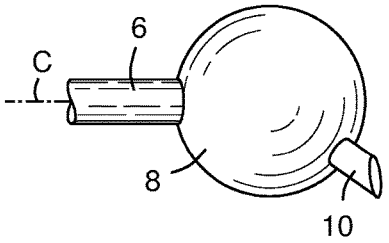
FIG. 3 is an enlarged side view of the ball and forward end of the cable of FIG. 1.

FIG. 1 is a side view of a drain cleaning device 2 with a drain snake 4 comprising a cable 6 with a ball 8 or other enlargement on the forward end of the cable, the ball has a larger diameter or width W than the diameter D of the cable. The leading surface of the ball has a protrusion 10 later described. In use, the cable may be guided by a cable feed guide 12 attached to a canister 14 for internal spooling. A drill arbor 16 may be provided on a cap 18 of the canister for rotating the canister with an electric drill. This rotates the cable during insertion of the snake into a drain pipe. Alternately or additionally, a hand crank may be provided, not shown. FIG. 2 is a sectional side view of the device of FIG. 1. FIG. 3 shows an enlarged view of the ball 8 and protrusion 10 on the forward end of the cable 6 in a first embodiment E1. The interior surface of the canister 14 has a diameter small enough to engage coils 19 of the cable frictionally, so that when the canister is turned, the cable turns with sufficient torque to overcome resistance in the drain pipe.

Figure 4:
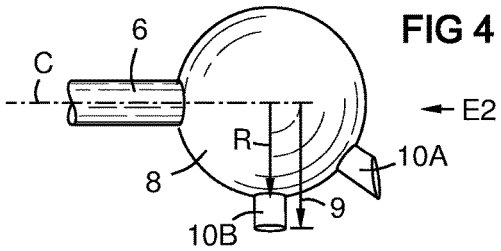
FIG. 4 shows an embodiment with two protrusions on the same side of the ball.

FIG. 4 shows an embodiment E2 with two protrusions 10A and 10B on the same side of the ball 8. The second protrusion 10B may extend from the side of the ball to a lateral distance 9 of 110-150% of the maximum lateral extent R of the ball or other enlargement. In a tested drain with only 19 mm (¾ inch) PVC pipe and elbows, embodiment E2 worked especially well. However, in a drain configuration that includes flexible tubing, embodiment E2 did not work because a bend in the flexible tubing partly flattened the flexible tubing of the drain, reducing its diameter and causing the second protrusion 10B to interfere. Accordingly, embodiments with protrusions that are limited laterally to the lateral extent R of the enlargement are beneficial for drains with flexible tubing. However embodiment E2 is especially effective where flexible tubing is not used, and the inner diameter of the pipe is constant.

Using a lateral protrusion 10B alone without a further forward protrusion 10A is not preferred because the forward protrusion 10A cuts deposits. Some drain deposits are hard, and must be broken-up by a forward cutting edge. Otherwise the nose of the ball can just spin against the deposit, failing to advance. For this reason, a first protrusion 10A may extend forward of the nose 34. In embodiment E2, each protrusion 10A, 10B serves a partly specialized function of cutting and stepping respectively, although both protrusions may also partly serve both functions.

Figure 5:
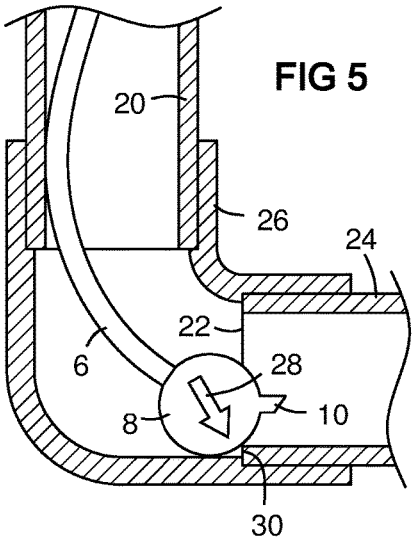
FIG. 5 is a side sectional view of a drain elbow during insertion of the snake into a first pipe until the ball stops against the end of a connected second pipe.

FIGS. 5-8 illustrate operation of the drain cleaning device. In FIG. 5, the snake is inserted into a drain access pipe 20 until the ball 8 stops against the partly exposed end 22 of a connected second pipe 24 in an elbow 26 of the drain. The ball is forced 28 into a ledge 30 created by the end of the continuing pipe, and cannot pass it. The force vector 28 is a resultant of the feed force along the cable and the bending resistance of the cable.

Figure 6:
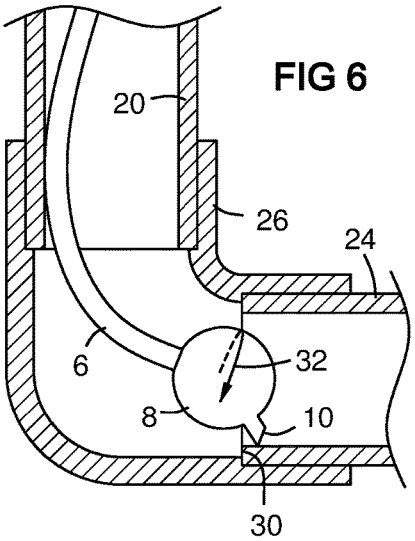
FIG. 6 is a view as in FIG. 5 showing the protrusion on the ball rotating onto the inner surface of the connected second pipe.
Figure 7:
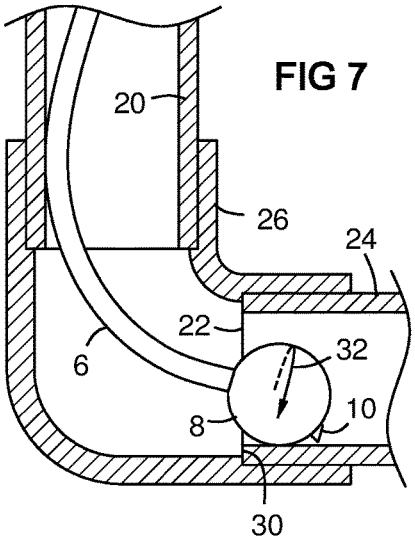
FIG. 7 is a view as in FIG. 5 showing the ball settling onto the inner surface of the connected second pipe as the protrusion rotates out from under the ball.
Figure 8:
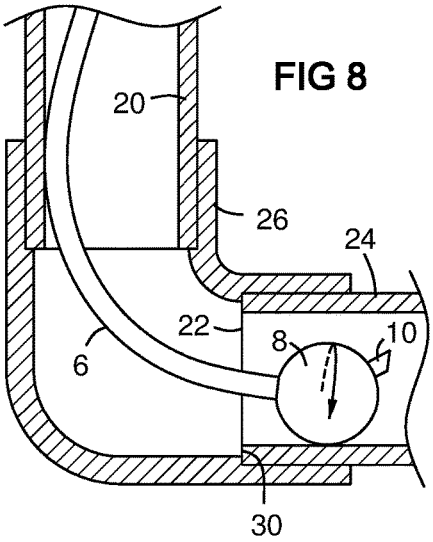
FIG. 8 is a view as in FIG. 5 showing the ball sliding down the second pipe.

A protrusion arrangement that is rotationally asymmetric with respect to the rotational axis of the enlargement or ball 8 is preferred. Herein the "rotation axis" of the enlargement is coincident with the centerline C of the cable when the cable is straight at the enlargement 8. Otherwise, the rotation axis is tangent to the centerline C at the enlargement when the cable is curved at the enlargement. Rotational asymmetry means the protrusion geometry changes when rotated less than 360 degrees. For example, a single protrusion or multiple protrusions on only one side of the enlargement forms a rotationally asymmetric arrangement. However, multiple substantially identical protrusions equally spaced around the rotational axis form a rotationally symmetric arrangement. A rotationally asymmetric arrangement avoids having a first protrusion camming other protrusion(s) into a hard deposit or against another part of the pipe end 22, potentially causing rotational or axial jamming FIG. 6 shows the ball 8 being rotated 32 by turning the cable 6. This causes the protrusion 10 to contact and push against the inner surface of the continuing pipe 24, thereby raising the ball over ledge 30. In FIG. 7 the protrusion 10 rotates out from under the ball, which sets the ball down on the inner surface of the continuing pipe 24 past the ledge 30. This action causes the ball to step over the ledge 30 and slide down the continuing pipe as shown in FIG. 8. Thus, the protrusion acts as a foot to step over the ledge. It also acts as a cutting or scraping device when it encounters a deposit in the pipe.

Figure 9:
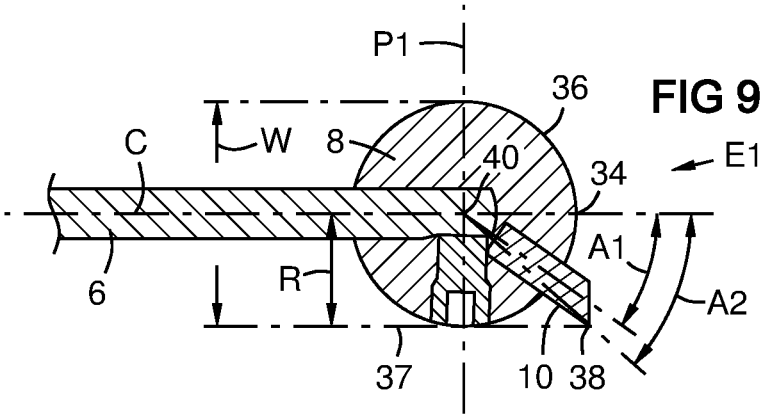
FIG. 9 is a side sectional view of a ball and protrusion arrangement illustrating aspects of an exemplary geometry and construction of an embodiment.

FIG. 9 is a side sectional view of an exemplary geometry and construction of embodiment E1 of the ball and protrusion configuration. The ball 8 has a most forward point or nose 34 and a convex leading surface 36 forward of a plane P1 that is normal to the centerline C of the cable 6 at a maximum width W of the ball. An effective shape of the leading surface 36 is spherical although other shapes may be used. The ball 8 may be a metal sphere of radius R with a hole to receive the forward end of the cable. If the enlargement 8 is not spherical, then R represents the maximum radial extent of the enlargement 8 from the cable centerline C. The ball may be attached to the cable with a set-screw as shown or it may be molded or bonded to the cable. The protrusion 10 may be a plastic rod inserted into a hole in the ball and retained by interference, adhesive, or the set-screw. Alternately, the ball and protrusion may be integrally molded. The protrusion 10 may terminate laterally at the lateral extent 37 of the enlargement 8 or at a distance from the rotation axis in the range of 60-150% or 80-130% of the lateral extent of the enlargement. "Laterally" herein means radially R from the rotational axis of the enlargement or ball 8.

The protrusion 10 embodied as a rod may extend forward and laterally from the leading surface 36, for example at an angle A1 of 30-45 degrees from the cable centerline C. A lateral limit 38 of the protrusion may coincide with the lateral extent 37 of the ball. This allows the ball to pass through clearances up to the width W of the ball. The lateral limit 38 of the protrusion may form an apex as shown, which may be located for example at an angle A2 of 35-50 degrees from the cable centerline when the origin of angle A2 is located at the geometric center 40 of the leading surface 36. Alternately, the protrusion may terminate in other shapes, including rounded.

Figure 10:
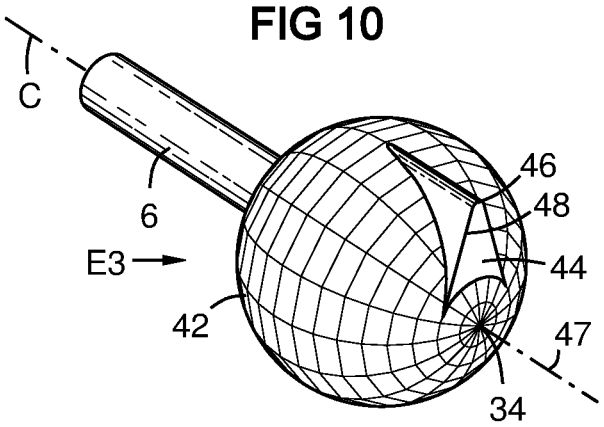
FIG. 10 is a surface view of an embodiment. Wire frames are left in the drawing, not to indicate physical faceting of the ball, but to clarify its orientation.

FIG. 10 is a perspective view of an embodiment E3. Graphic wire frames are left in the drawing to clarify the shape and orientation of the ball 42—not to require physical faceting. A protrusion 44 is formed as a ridge on one side of the leading surface of the ball. The ridge may have an apex 46, which may be limited laterally to the radius or width of the ball relative to its rotation axis, allowing the ball to slide through clearances up to the width of the ball. In an embodiment, the front of the protrusion may form sharp cutting edges 48 that cut through deposits in the drain line.

Figure 11:
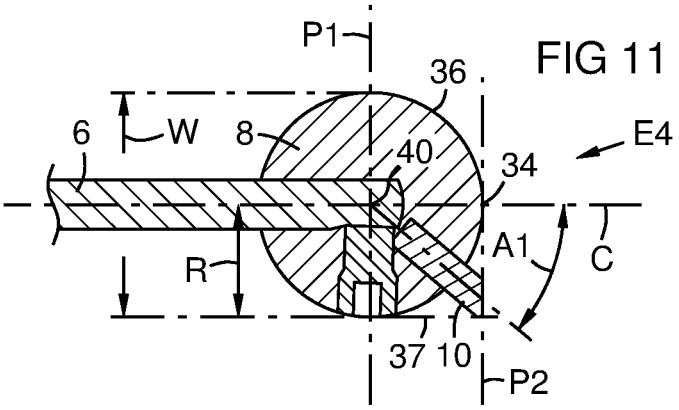
FIG. 11 is a sectional view of an embodiment with specific lateral and forward termination limits on the protrusion.

FIG. 11 shows an embodiment E4 in which the protrusion 10 is a rod extending forward and laterally from the ball 8. The rod terminates laterally along a limit 37 defined by the lateral extent 37 or radius R of the ball. The limit 37 may be a cylinder defined by the radius R of the ball and the rotational axis of the ball as previously defined. The rod may further terminate along a plane P2 normal to the cable centerline C and positioned substantially at the nose 34 of the convex leading surface 34. These lateral and forward limits provide stepping and cutting features of the protrusion, while minimizing its size. However, more aggressive stepping and cutting features may be provided for drains of predictable diameter by respectively extending the protrusion laterally beyond the lateral extent 37 of the ball and/or forward of the nose 34.

Figure 12:
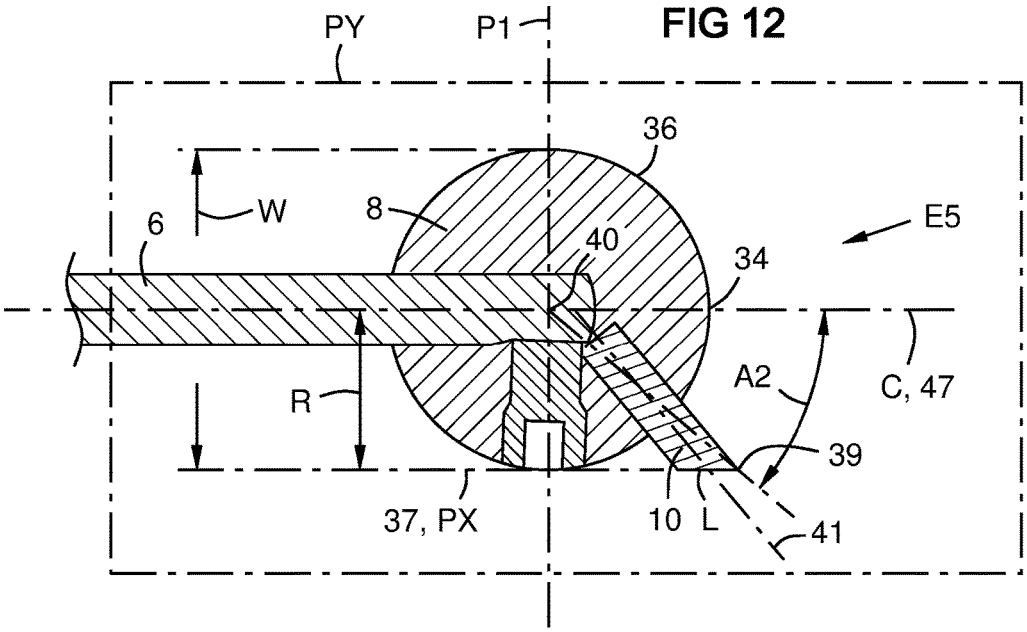
FIG. 12 is a sectional view of an embodiment with a specific lateral termination on the protrusion.

FIG. 12 shows an embodiment E5 in which the protrusion 10 extends forward and laterally from the leading surface 36 the ball 8. The protrusion terminates laterally along a limit 37 defined by the lateral extent or radius R of the ball. The limit 37 may be a plane PX for example parallel to the ball rotation axis 47 and perpendicular to a plane PY defined by the ball rotation axis and a centerline 41 of the protrusion 10. Alternately the limit 37 may be a cylinder defined by the radius R of the ball and the rotational axis of the ball or the centerline of the pipe in which it will be used. The angle of the lateral foot surface L provides a scraper for the inner surfaces of the pipe. It also forms a forward point 39 on the protrusion that undercuts deposits and separates them from the inner surface of the pipe. The forward point may optionally be forward of the nose 34 of the ball to help clear a path for the ball. While the protrusion 10 may be limited laterally by limit 37 as shown, it may alternately extend beyond limit 37. Limiting it to limit 37 as shown is beneficial for drains with flexible tubing as previously described.

Figure 13:
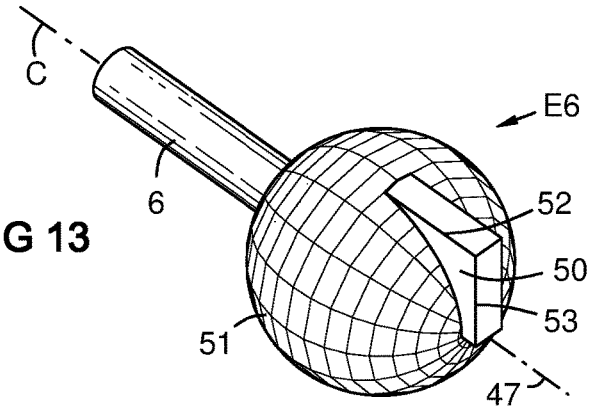
FIG. 13 is a perspective view of another embodiment.

FIG. 13 is a perspective view of an embodiment E6. Graphic wire frames are left in the drawing to clarify the shape and orientation of the ball 51—not to require physical faceting. A protrusion 50 extends from the convex leading surface of the ball to terminate laterally at a distance from the rotation axis 47 of the ball in the range of 60-150% or 80-130% of a maximum lateral extent of the ball. In the example shown, the protrusion terminates laterally at the lateral extent of the ball, and forms a sharp side cutting edge 52 aligned with the rotation axis 47 to scrape the sides of the pipe. The protrusion extends forward of the most forward point of the ball 51, and forms a sharp forward cutting edge 53, which may be straight as shown, or may be curved, especially convex, wavy, or saw-toothed (not shown).

Figure 14:
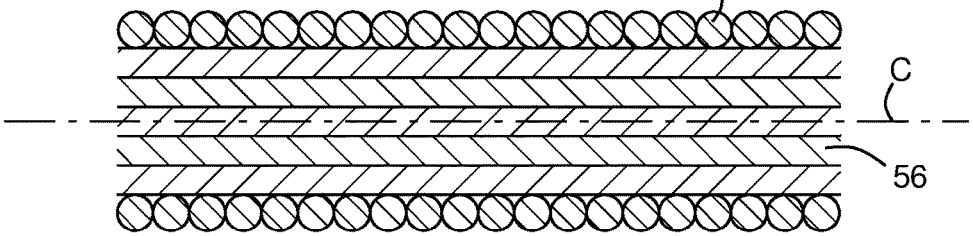
FIG 14 Prior Art
FIG. 14 is a side sectional view of a cable suitable for the invention.

FIG. 14 is a side sectional view of a type of cable 6 suitable for the invention. It has multiple longitudinal fibers 56 surrounded and compressed by a tight helical winding 57. This type of cable is laterally flexible enough to turn 90 degrees in a drain elbow, but it is substantially inelastic longitudinally under manual feed and retraction forces due to the longitudinal fibers 56. Thus, it transmits feed and retraction forces firmly to the ball 8. The fibers 56 and windings 57 may be steel. This construction allows the cable to be relatively small in diameter such as 3.2 mm (0.13 inch), which provides suitable torsion, axial force, and flexibility for condensate drains. However, other cable designs may be used if they provide the necessary torque and axial force. Small diameter torque cables are commercially available, and are described for example as multi-strand flexible cables or multi-strand bi-directional torque cables or shafts.

FIG. 15 is a perspective view of an opened conventional drain snake canister 58 and cable feed guide 59 adapted to the present invention. The present cable is smaller in diameter and thus more laterally flexible than a conventional drain snake so it requires a smaller diameter canister 60 to frictionally engage the coils for rotating the cable. The adapter canister 60 may be installed inside a conventional canister 58 by adhesive or other means. This takes advantage of the remaining aspects of the conventional canister and feed guide, which may include for example, a hand crank and a feed guide journal with a handle. The inner diameter of the feed guide is preferably reduced with a tubular insertion in the feed guide to better match the smaller cable diameter. FIG. 16 shows a back view of the device of FIG. 15 with a cable 6 installed.

Figure 17:
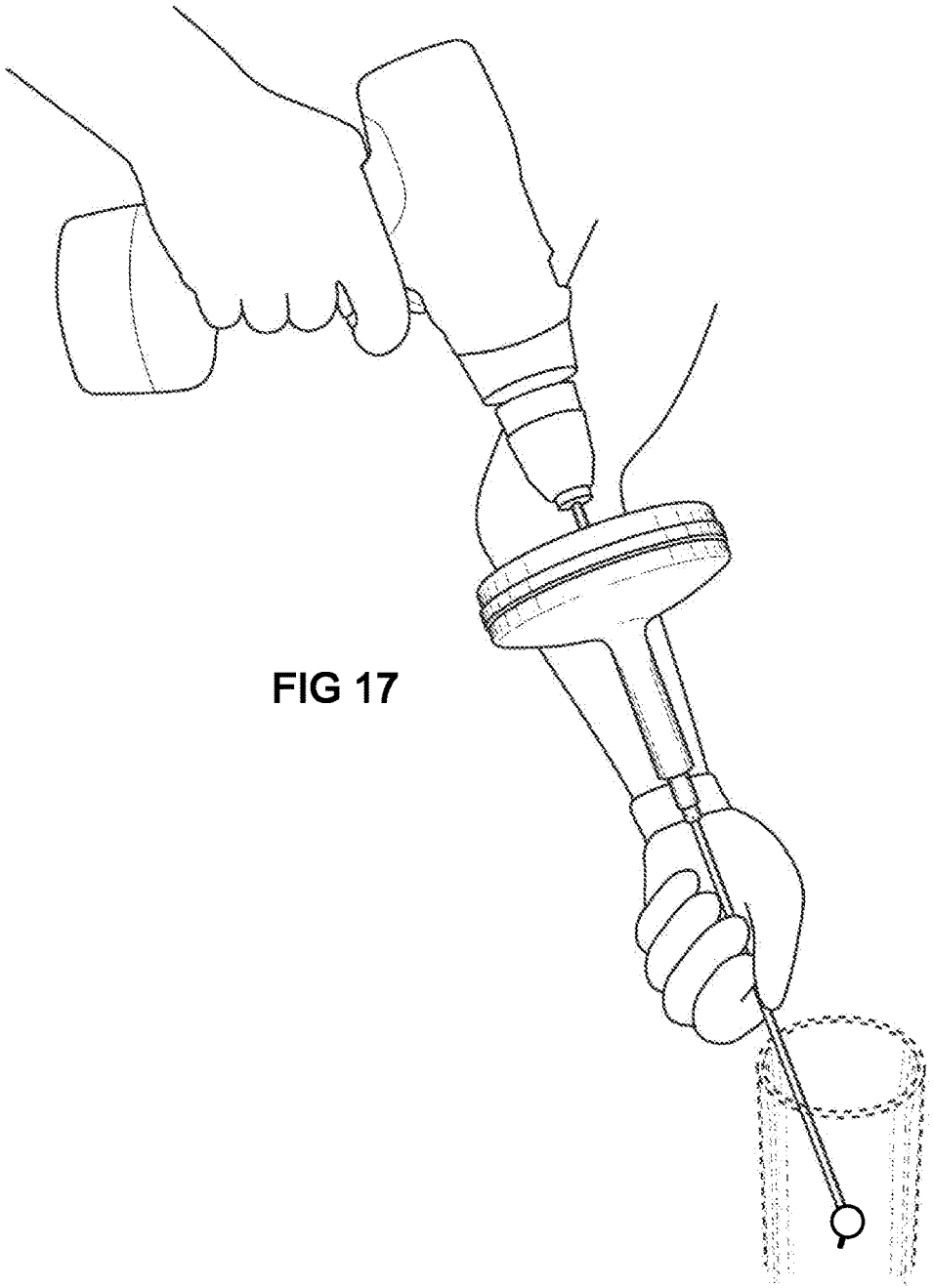
FIG. 17 illustrates a method of operating the invention, which applies both to an adapted conventional drain snake canister or the canister of FIGS. 1 and 2.

FIG. 17 illustrates a method of operation of the invention with the adapted conventional canister 60 of FIGS. 15 and 16, which also applies to the canister design of FIGS. 1 and 2.

The inventor found in testing that a snake with a ball 8 and protrusion 10 as in FIG. 3 negotiates multiple elbows in a conventional PVC condensate drain. This solves a long-standing unsolved need. However, when the protrusion is removed, the ball will not pass even the first elbow. A spherical ball is a preferred enlargement. An ellipsoidal ball can be used, but this lengthens the ball, making it more resistant to turning corners. Herein the term "convex" includes spherical, ellipsoidal, convex conical, and other convex shapes. A single ball or enlargement on the end of the cable is preferred over multiple balls or enlargements along the cable, because each additional ball or other enlargement would add resistance to passing through the elbows. Each ball or other enlargement would need a respective protrusion to step over the ledges 30 of the drain.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A drain cleaning device comprising:

a drain snake comprising a cable with an enlargement on a forward end thereof;

a convex leading surface on the enlargement; and a rotationally asymmetric protrusion arrangement on the enlargement comprising a protrusion extending from the leading surface to a lateral limit of 60-150% of a maximum lateral extent of the enlargement relative to a rotational axis thereof.

2. The drain cleaning device of claim 1, wherein the rotationally asymmetric protrusion arrangement is limited in lateral extent to less than or equal to the maximum lateral extent of the enlargement.

3. The drain cleaning device of claim 1, wherein the protrusion arrangement comprises a first protrusion on the convex leading surface that terminates laterally at 80-130% of the maximum lateral extent of the enlargement.

4. The drain cleaning device of claim 3, wherein the first protrusion terminates forwardly ahead of a most forward point of the convex leading surface.

5. The drain cleaning device of claim 3, wherein the protrusion arrangement further comprises a second protrusion extending laterally from the enlargement to a lateral extent of 110-150% of the maximum lateral extent of the enlargement, and the second protrusion is disposed behind and on the same side of the enlargement as the first protrusion.

6. The drain cleaning device of claim 1, wherein the convex leading surface comprises a smooth metal surface, and the protrusion comprises a plastic rod inserted into the enlargement and extending forward and laterally from the convex leading surface at an angle of 30 to 40 degrees from the rotational axis of the enlargement.

7. The drain cleaning device of claim 1, wherein the enlargement is a ball, the leading surface is a front surface of the ball, and said ball is the only enlargement on the cable.

8. A drain cleaning device comprising:

a drain snake comprising a ball on a forward end of a cable, the ball comprising a convex leading surface extending forward of a first plane normal to a centerline of the cable at a maximum width of the ball; and a protrusion extending from the convex leading surface to a lateral limit of 80-130% of a maximum lateral extent of the ball relative to a rotational axis thereof.

9. The drain cleaning device of claim 8, wherein the convex leading surface comprises a smooth metal surface, and the protrusion is a plastic rod inserted into the ball and extending forward and laterally from the convex leading surface at an angle of 30 to 45 degrees from the rotational axis.

10. The drain cleaning device of claim 8, wherein the convex leading surface is spherical, and the protrusion terminates laterally at an apex located at an angle of 35 to 50 degrees from the rotational axis, wherein the origin of said angle is located at the geometric center of the spherical leading surface.

11. The drain cleaning device of claim 10, wherein the protrusion terminates laterally at a distance from the rotational axis of 80-130% of the radius of the convex leading surface.

12. The drain cleaning device of claim 8, wherein the protrusion comprises a planar front surface in a second plane normal to the cable centerline.

13. The drain cleaning device of claim 8, wherein the lateral limit of the protrusion is substantially the maximum lateral extent of the ball, and the protrusion terminates forward along a second plane normal to the rotational axis substantially at the forward end or nose of the convex leading surface of the ball.

14. The drain cleaning device of claim 13, wherein the protrusion comprises a plastic rod extending forward and laterally from the convex leading surface at an angle of 30 to 40 degrees from the cable centerline.

15. The drain cleaning device of claim 8 comprising only a single protrusion in accordance with said protrusion on the convex leading surface of the ball.

16. The drain cleaning device of claim 8, wherein the protrusion terminates laterally in a limit, wherein the limit comprises a second plane parallel to the ball rotation axis, and the second plane is perpendicular to a third plane defined by the ball rotation axis and a centerline of the protrusion, or the limit comprises a cylindrical surface defined by the radius of the ball and the ball rotational axis.

17. A drain cleaning device comprising:

a drain snake comprising a cable with a ball on a forward end thereof;

a convex leading surface on the ball; and a protrusion extending from the convex leading surface to terminate at a distance from a rotation axis of the ball in the range of 60-150% of a maximum lateral extent of the ball relative to the rotation axis.

18. The drain cleaning device of claim 17, wherein said protrusion comprises a sharp front cutting edge disposed forward of a most forward point of the leading surface.

19. The drain cleaning device of claim 18, wherein the protrusion further comprises a sharp lateral cutting edge aligned with the rotation axis of the ball at a distance equal to or greater than the maximum lateral extent of the ball.

20. The drain cleaning device of claim 17, wherein the ball comprises a rotationally asymmetric protrusion arrangement comprising said protrusion.

* * * * *